United States Patent [19]

Wing et al.

[11] 3,953,283

[45] Apr. 27, 1976

[54] PAPERBOARD HAVING IMPROVED OIL RESISTANCE

[75] Inventors: James H. Wing; James N. Stone, both of Augusta; Franklin B. Thomas, III, Martinez, all of Ga.

[73] Assignee: Continental Can Company, Inc., New York, N.Y.

[22] Filed: Oct. 5, 1972

[21] Appl. No.: 295,382

[52] U.S. Cl. ..... 162/158; 162/175; 162/178; 162/179

[51] Int. Cl.[2] ..... D21H 3/02; D21H 3/28

[58] Field of Search ..... 162/158, 175, 179, 178; 260/947

[56] References Cited

UNITED STATES PATENTS

| | | | |
|---|---|---|---|
| 3,094,547 | 6/1963 | Heine | 260/947 |
| 3,112,241 | 11/1963 | Mackenzie | 162/164 |
| 3,274,244 | 9/1966 | Mackenzie | 162/158 X |
| 3,378,399 | 4/1968 | Rambosek | 162/158 |
| 3,392,085 | 7/1968 | Oliver | 162/175 |
| 3,562,099 | 2/1971 | Wasko et al. | 162/158 X |
| 3,562,100 | 2/1971 | Wasko et al. | 162/158 X |
| 3,692,885 | 9/1972 | Anello | 162/158 |

*Primary Examiner*—S. Leon Bashore
*Assistant Examiner*—William F. Smith
*Attorney, Agent, or Firm*—Paul Shapiro; Joseph E. Kerwin; William A. Dittmann

[57] ABSTRACT

Paperboard having improved resistance to oils is obtained by incorporating in the pulp suspension before paper formation a mixture of a cationically active material, a fatty acid salt and a bis-perflourosulfonamino alkyl phosphate.

2 Claims, No Drawings

PAPERBOARD HAVING IMPROVED OIL RESISTANCE

BACKGROUND OF THE INVENTION

1. Field of the Invention

This invention relates to a process for manufacturing paperboard and more specifically to a process for obtaining a paperboard which is substantially oil impervious.

2. The Prior Art

In the packaging of oils and compositions containing these materials, the use of metal containers has dominated the field due to the inability of the oils to penetrate the metal. However, metal containers are relatively expensive and attempts have been made to replace the metal containers with paperboard coated with oil impervious coatings. The coatings, however, have been found to be either expensive, and thus undesirable from an economic viewpoint, or if inexpensive, retain their imperviousness for only a short period of time and thus are undesirable from a quality standpoint. Further, such coated paperboard cannot be recycled back into the pulping process using conventional repulping methods.

SUMMARY OF THE INVENTION

In accordance with the present invention there is provided a process of preparing paperboard having high oil resistance wherein a mixture of a cationically active material, a fatty acid salt and a polyfluoroalkyl compound is incorporated in the paper pulp prior to the formation of the pulp into paperboard. Paperboard prepared in this manner can be easily recycled using conventional repulping methods.

PREFERRED EMBODIMENTS

In practicing the process of the present invention, wood fibers are refined to a desired fiber length and then diluted with water to form an aqueous suspension preparatory to paper formation. A homogenous mixture of a water soluble cationically active material, a fatty acid salt and a polyfluoroalkyl compound is then added to the aqueous suspension either prior to or following the addition of a water soluble precipitating agent which is added in sufficient amounts to provoke the forming of water insoluble soaps of the fatty acid throughout the fiber mass.

The so-treated pulp is then processed in the conventional manner for formation into paper or paper board. Thus, the pulp having incorporated therein the insolubilized fatty acid salt, cationically active material and polyfluoroalkyl compound is passed over a moving wire, whereby part of the water drains off, leaving a mat of fibers or wet web. The wet web is passed from the moving wire to a press section where additional water is removed, thence to a drier section where heat is used to evaporate the remaining water, at which point further treatment may be applied (such as calander sizing, coating, etc.) before the continuous dry sheet is wound on a reel or cut into individual sheets.

The paper product obtained by the process of the present invention exhibits superior resistance to oils and is characterized by having relatively homogeneously dispersed throughout the mass of the paper, as contrasted to a mere superficial coating of the surface of the paper, a mixture of a cationically active material, an insoluble fatty acid salt and a polyfluoroalkyl compound as hereinafter described.

The cationic materials used in the practice of the presention invention are cationically modified starches or gums and hydrogen-bonding starches and gums. The latter, while not technically classified as cationic materials, behave in a very similar manner, and are equivalent in function to the cationically modified starches and gums used in the practice of the present invention.

A wide diversity of cationically active materials are available to the art and disclosure of those most useful in the practice of the present invention may be found in U.S. Pat. No. 3,392,085, the disclosure of which is incorporated herein by reference.

Cationically modified starches and gums are obtained by modifying naturally occurring starches and gums so that they exhibit a cationic charge, i.e., a positive charge, when dissolved in aqueous medium. Cationically modified starches and gums are conveniently obtained by the reaction of naturally occurring starches such as corn starch and potato starch with an etherification agent such as dialkyl aminoalkyl epoxides or dialkyl aminoalkyl halides following the procedures of U.S. Pat. Nos. 2,813,093 and 2,917,506, or epichlorohydrin and a tertiary amine following the procedure of U.S. Pat. No. 2,876,217.

Many cationically modified starches and gums which may be employed for use in the present invention are available commercially.

A cationic corn starch is sold by National Starch and Chemical Corp. under the trademark CATO 8. A cationic potato starch is sold by A. M. Menickle and Sons, under the trademark EPIC-N.

The cationically modified gums which may be employed in the present invention are extracts from vegetable saps, seeds and seaweed synthetically modified according to the same procedures used to render starches cationically active. Illustrative of such gums are locust bean gums, guar gums, kararya gums, agar and alginates.

A cationically modified galactomannan guar gum is sold by Stein, Hall and Company, Inc., under the trademark DRAYBOND II.

Hydrogen bonding starches and gums may be extracted from their respective vegetable orgins and used directly in the practice of the present invention and other non-hyrdogen-bonding gums may be rendered so active by chemical treatment.

The naturally occurring hydrogen bonding starches and gums are characterized in that there are numerous hydroxyl groups on the monosaccharide units and these are sterically arranged so that hydrogen bonding occurs between the chains. Such hydrogen-bonding is generally attributed to the presence and behaviour of these hydroxyl groups.

Tamarand seed flour is an example of hydrogen-bonding gum having cationic-type properties and is composed of glactose, xylose and glucose units in the approximate molar ratio of 1:2:3,, and is sold by Dycol Chemicals, Inc., under trademark DYCOL D-16.

Another hydrogen-bonding gum is that obtained by extraction from the guar plant. While this guar gum may be employed in the present invention as the cationic material, it may also be chemically treated to attain a cationic charge such as by the etherification processes used for the starches.

Guar gums in unmodified form, as well as those in cationic form, are marketed by Stein, Hall and Company, Inc., under the trademark JAGUAR.

Locust bean gum may also be employed as a hydrogen bonding, naturally occurring galactomannan.

In the practice of the present invention, the fatty acid salt is added to the paper pulp as a soluble metal salt which is insolubilized on the paper fibers using a precipitating agent. The fatty acid salts are generally added to the pulp as either the sodium, potassium or ammonium salts.

The cations of the insolubilized fatty acid salts are aluminum ($Al^{3+}$), ferric ($Fe^{3+}$) and/or chromic ions ($Cr^{3+}$).

The fatty acid employed may be any one or a mixture of the saturated fatty acids having from 12 to 20 carbon atoms. Illustrative saturated fatty acids include lauric-$C_{12}$, tridecylic-$C_{13}$, myristic-$C_{14}$, pentadecylic-$C_{15}$, palmitic-$C_{16}$, margaric-$C_{17}$, stearic-$C_{18}$, nondecylic-$C_{19}$ and arachidic-$C_{20}$.

Various mixtures of these fatty acids may be commercially obtained and the commercial products usually contain some proportion of unsaturated fatty acids. For best results, the amount of unsaturated fatty acid component should not exceed 30% by weight of the fatty acid and preferably the fatty acid should not contain greater than 7% unsaturated fatty acids. Various commercially obtainable fatty acid mixtures from which the soluble fatty acid salt may be prepared are sold by Armour Industrial Chemical Company under tradenames: Neo-Fat 18S, Neo-Fat 18, Neo-fat 18-58 and Neo-Fat 58-59; and Darling and Company under tradenames; Dar-Hy, Dar-C and Dar-S77. These commercial mixtures are generally low in unsaturated fatty acid content and contain greater than 80% of at least one or a mixture of stearic, palmitic, margaric and myristic acids.

The precipitating agent which is employed for insolubilizing the water soluble saturated fatty acid salts are water soluble inorganic metal salts of polyvalent metallic ions such as aluminum, ferric and chromic. Illustrative of these salts are aluminum sulfate, aluminum chloride, potassium sulfate-aluminum sulfate salts, ferric sulfate and chromic sulfate. The aluminum sulfate and potassium sulfate-aluminum sulfate salts normally referred to as alums, are preferred in the practice of the present invention. The alum employed may be anhydrous alum, $Al_2(SO_4)_3$; papermakers alum, $Al_2(SO_4)_3 \cdot 18\ H_2O$ and common alum, $K_2SO_4\ Al_2(SO_4)_3 \cdot 24\ H_2O$. When the term "alum" is employed in the working examples, below, papermakers alum is intended. The precipitating agent is added to the pulp suspension in an amount which will create an excess of polyvalent metal ions in solution over the amount which would be required for a stoichiometric reaction to precipitate the insoluble fatty acid salt.

One class of water soluble polyfluoroalkyl compounds which has been found effective in the practice of the present invention is the water soluble polyfluoroalkyl sulfonamino phosphates. One group of polyfluoroalkyl sulfonamino phosphates which are commercially available are the bis-perfluorosulfonamino alkyl phosphates having the general formula

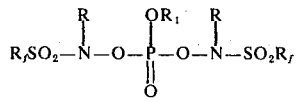

wherein, $R_f$ is a perfluoroalkyl having 4 to 12 carbon atoms, R is hydrogen or an alkyl group having 1 to 6 carbon atoms and $R_1$ is an alkyl group having 1 to 6 carbon atoms. An example of a commercially available bis-perfluorosulfonamino alkyl phosphate is bis-N-ethyl-2-perfluoroalkyl sulfonamino ethyl phosphate sold by the 3-M Company under the designation FC-807 Paper Chemical.

The pulp suspension which is to be treated in accordance with the present invention may be made up with refined fibers such as: bleached and unbleached fibers, ground wood, soda pulp fibers, semi-chemical fibers, kraft fibers, sulphite fibers, textile and synthetic fibers, such as viscose rayon and cellulose acetate, and other cellulosic fibers. The pulp is generally refined to a Canadian Freeness value of from 400–700 milliliters before addition of the cationically active material, fatty acid salt and polyfluoroalkyl compound. The pulp consistency is normally 0.3 to 0.6 percent by weight, although considerable variation is possible.

Pulp suspensions after refining, normally have pHs of approximately 7.0–8.0. It is a critical feature of the present invention that the pH of the pulp suspension be adjusted to a pH range of from 5.8–7.3 and preferably 6.0–6.8 during the addition of the cationically active material, fatty acid salt and polyfluoroalkyl compound to the pulp suspension. As will hereinafter be illustrated, if the pH of the pulp suspension is outside this critical range, the paperboard product prepared from pulp treated in accordance with the present invention will exhibit inferior oil resistance.

In the practice of the present invention the cationically active material is added to the pulp suspension at a concentration of 0.10 to 6.0% based on the weight of the solids content of the suspension and preferably 0.70 to 2.0% by weight of the solids content of the suspension.

The water soluble fatty acid salt is added to the pulp suspension at a concentration of 0.10 to 10.0% based on the weight of the solids content of the pulp suspension and preferably 0.50 to 6.50% by weight of the solids content of the suspension.

The polyfluoroalkyl compound is added to the pulp suspension at a concentration of about 0.07 to 0.50% by weight based on the weight of the solids content of the suspension and preferably about 0.10 to 0.30% by weight of the solids content of the suspension.

The following examples further illustrate the practice of the present invention; however, the examples are not to be construed as limiting the scope of the invention.

EXAMPLE I

In this Example, the operation of the paper machine to manufacture highly oil resistant paperboard was similar to the method of manufacturing a routine grade paperboard with the exception that a mixture of a cationically active material, a fatty acid salt and a polyfluoroalkyl compound was incorporated in the pulp suspension.

A fiber suspension of bleached pulp containing no additives and consisting of 84% pine and 16% hardwood pulp was refined to a Canadian Standard Freeness of 565–578 milliliters and a pulp consistency of 3.5 – 4.1%. The pH of the refined pulp was adjusted to a pH of 8.0 with lime. To the pulp was then added 1.07% by weight (based on the weight of the solids content of the suspension) CATO 8, a cationic corn starch and 4.93% by weight (based on the weight of the solids content of the suspension) potassium stearate and the pH was lowered to varying pHs with 0.5 to 12% by weight (based on the dry weight of the fibers) alum. This amount of alum was sufficient to completely precipitate the stearate salt on the pulp fibers. Paper chemical FC-807 was added to the pulp suspension as well as 0.4% Vanzak RA-30, a cationic retention aid. The pulp suspension was processed into paperboard in the conventional manner and wound on a reel.

Samples were cut from the paperboard roll into square foot sheets and conditioned for 24 hours at 50% relative humidity and 73°F. before testing for oil resistance.

The test for oil resistance comprised applying a one-half inch head of corn oil (Mazola oil) to the surface of the paperboard and measuring the length of time required for the oil to penetrate the paperboard and stain 50% of the under surface. The results of these tests were recorded in Table I below.

For purposes of contrast, paperboard prepared in accordance with the procedure of Example I with the exception that concentrations of FC-807 and pHs outside the scope of the invention were used. The results of these contrasting runs are also recorded in Table I and designated by the Symbol "C".

TABLE I

| Test No. | %* FC-807 | Pulp pH | Oil Resistance |
|---|---|---|---|
| 1 | 0.10 | 7.1 | 20 days |
| 2 | 0.10 | 6.2 | 20 days |
| $C_1$ | 0.05 | 6.2 | 6 hours |
| $C_2$ | 0.10 | 5.5 | 17 hours |

*Based on dry weight of fiber.

EXAMPLE II

Handsheets were made from a suspension of bleached pulp containing no additives and consisting of 85% pine wood pulp and 15% hardwood pulp. The pulp was refined to a Canadian Freeness of 575 mls. Varying concentration of CATO 8, potassium stearate and FC-807 were added to the pulp suspension before handsheet formation. The pulp suspension was adjusted pH 8 with lime before addition of the additives, and then to pH 6 with alum. The amount of alum (1.00% by weight based on the weight of the dry pulp) used to adjust the pH was sufficient to precipitate any potassium stearate added to the pulp slurry. The handsheets were conditioned overnight at 50% relative humidity and 73°F. and then tested for oil resistance.

Oil resistance was determined by applying corn oil tinted with a red dye to one side of the handsheet. The reflectance of the opposite side of the handsheet was measured photoelectrically with a Hercules Size Tester. The reflectance measured on the opposite side at the start of the test was assigned a value of 100%. Oil resistance was determined as the time required for the tinted oil to penetrate the handsheet and reduce the reflectance of the opposite side of the handsheet to a value which was 70% of the originally measured reflectance. The results of the oil resistance tests are recorded in Table II below.

For purposes of contrast, handsheets were prepared from pulp suspensions in which either CATO 8, potassium stearate or FC-807 was not added. The results of these comparison tests, designated by the symbol C, are also recorded in Table II.

TABLE II

| Test No. | %* CATO 8 | %* Potassium Stearate | %* FC-807 | Oil Resistance, Sec. |
|---|---|---|---|---|
| 1 | 0.36 | 1.64 | 0.30 | 518,400 |
| 2 | 0.71 | 3.29 | 0.20 | 345,600 |
| 3 | 1.07 | 4.93 | 0.10 | 345,600+ |
| $C_1$ | 0 | 0 | 0 | 5.3 |
| $C_2$ | 0 | 0 | 0.17 | 5.8 |
| $C_3$ | 0 | 0 | 0.35 | 7.7 |
| $C_4$ | 0 | 4.72 | 0.10 | 420 |
| $C_5$ | 1.03 | 0 | 0.10 | 86,400 |
| $C_6$ | 1.78 | 8.22 | 0.05 | 25,800 |
| $C_7$ | 1.78 | 8.22 | 0 | 381 |
| $C_8$ | 2.14 | 9.86 | 0 | 8,581 |

*Based on the dry weight of the pulp.

An examination of the date in Tables I and II above clearly indicates that the practice of the present invention of incorporating a mixture of a cationically active material, a fatty acid salt and a polyfluoroalkyl compound in paper pulp prior to the formation of the pulp into paperboard, at the presently disclosed concentrations and pHs, results in a paperboard which exhibits improved oil resistance, the improvement in oil resistance being especially demonstrated when comparisons are made with processes in which one or more of the features of the presently claimed invention are omitted from the process.

What is claimed is:

1. A process for preparing paperboard from cellulosic pulp having improved oil resistance which comprises adjusting the pH of a suspension of cellulosic pulp between 5.8 and 7.3, adding to the suspension an additive mixture of (1) 0.10 to 6.0 percent by weight of a cationically active material selected from the group consisting of cationically active starches and gums and hydrogen bonding starches and gums (2) 0.10 to 10.0 percent by weight of a water soluble salt of a saturated fatty acid having 12 to 20 carbon atoms and (3) about 0.07 to 0.50 percent by weight of a water soluble bis-perfluorosulfonamino alkyl phosphate based on the solids content of the suspension, the bis-perfluorosulfonamino alkyl phosphate having the general formula

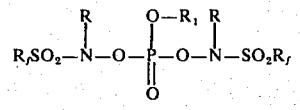

wherein $R_f$ is a perfluoroalkyl group having 4 to 12 carbon atoms, R is selected from the group consisting of hydrogen and an alkyl group having 1 to 6 carbon atoms and $R_1$ is an alkyl group having 1 to 6 carbon atoms, precipitating the water soluble fatty acid salt throughout the pulp surface, forming the pulp containing the additive mixture into a fibrous web and then drying the fibrous web to form the oil resistant paperboard.

2. The process of claim 1 wherein the bis-perfluorosulfonamino alkyl phosphate is a bis-N-ethyl-2-perfluoroalkyl sulfonamino ethyl phosphate.

* * * * *